United States Patent [19]

Lautenschlager et al.

[11] 4,184,228

[45] Jan. 22, 1980

[54] QUADRUPLE KNUCKLE JOINT CABINET HINGE

[75] Inventors: Karl Lautenschläger, Reinheim; Gerhard Lautenschläger, Brensbach-Wersau, both of Fed. Rep. of Germany

[73] Assignee: Karl Lautenschläger KG, Mobelbeschlagfabrik, Reinheim, Fed. Rep. of Germany

[21] Appl. No.: 880,456

[22] Filed: Feb. 23, 1978

[30] Foreign Application Priority Data

Feb. 28, 1977 [DE] Fed. Rep. of Germany ..... 2708545

[51] Int. Cl.[2] ..... E05F 5/02

[52] U.S. Cl. ..... 16/86 A; 16/145

[58] Field of Search ..... 16/85, 86 A, 142, 145, 16/163, 164, 180, 82

[56] References Cited

U.S. PATENT DOCUMENTS

| | | | |
|---|---|---|---|
| 3,564,643 | 2/1971 | Salice | 16/180 X |
| 3,655,228 | 4/1972 | Coopersmith et al. | 16/86 A X |
| 4,075,735 | 2/1978 | Rock et al. | 16/163 X |
| 4,123,823 | 11/1978 | Lautenschläger | 16/145 |

FOREIGN PATENT DOCUMENTS

| | | | |
|---|---|---|---|
| 767347 | 9/1967 | Canada | 16/164 |
| 2337224 | 2/1975 | Fed. Rep. of Germany | 16/142 |
| 2408057 | 8/1975 | Fed. Rep. of Germany | 16/145 |
| 436019 | 11/1967 | Switzerland | 16/163 |

*Primary Examiner*—Werner H. Schroeder
*Assistant Examiner*—Moshe I. Cohen

[57] ABSTRACT

Cabinet hinge having two hinge links pivotingly attached to a door-related member on the one hand and to a wall-related member on the other, in the manner of a quadruple knuckle joint, wherein in the space between the hinge links, a resiliently deformable damping means is disposed such that, upon a swinging of the hinge into the open position, it is deformed while resting against at least one of the hinge links shortly before reaching the designated end position.

7 Claims, 4 Drawing Figures

12
14
60

50
62
42
46
44
16
18
70
24
68
22
64
20

62
70
60
68
42

46
14
18
64
16
66
20
24
12
22

QUADRUPLE KNUCKLE JOINT CABINET HINGE

BACKGROUND

The invention relates to a cabinet hinge having two hinge links pivotingly attached to the door-related member of the hinge at one end and to the wall-related member of the hinge at the other end, in the manner of a quadruple knuckle joint.

Such quadruple knuckle joint hinges, in which the door-related member is made, as a rule, in the form of a cup to be inserted into a mortise in the door, and the supporting wall-related part is in the form of an elongated arm adjustably fastened on a mounting plate fastened to the supporting wall of the cabinet, have become increasingly popular in furniture construction in recent years because they not only can be mounted invisibly in the interior of the cabinet, but they also permit cinematically desirable door opening and closing movements, with door opening angles of as much as 115°. These hinges are often equipped with an additional over-center mechanism which by spring force urges the associated door into two stable end positions, namely either the fully closed or the fully open end position. When doors equipped with such quadruple knuckle joint hinges are opened with such vigor that they swing into the open position with a relatively great speed, or when an over-center mechanism provided in the hinges has such a strong spring bias that the door is accelerated at considerable speed to the open position, the kinetic energy residing in the door must be dissipated as quickly as possible when the door reaches the open position, i.e., shocks occur which in the course of time can lead to a loosening of the mounting of the door-related member or of the supporting wall-related member of the hinge. On the other hand, a vigorous closing of the door is less critical, because in this case the inside of the door usually strikes against the face of the supporting wall or a rabbet in the supporting wall, so that the shocks occur directly between the door and the carcase of the cabinet.

THE INVENTION

The invention, therefore, is addressed to the problem of improving the known quadruple knuckle joint hinge such that the hinge components and the means whereby they are fastened to the cabinet are relieved from shock stresses such as those which can develop when a cabinet door swings with high kinetic energy into the open position.

This problem is solved in accordance with the invention in that a resiliently deformable damping means is so disposed in the space between the hinge links of the hinge that, upon the pivoting of the hinge into the open position, it will be deformed against at least one of the hinge links shortly before reaching the design end position. The kinetic energy of the door is thus dissipated over a certain angle of swing in the vicinity of the open position by the deformation of the damping means, thereby eliminating shock in the stopping of the door.

The damping means can be fastened to one of the hinge links and can then engage the other hinge link or directly or indirectly engage one of the members of the hinge when the door approaches the open position.

In this case the damping means can be fastened, for example, on the side of the inner hinge link facing the outer hinge link or, alternatively, on the side of the outer hinge link facing the inner hinge link.

The damping means can also be constructed in one piece from the material of one of the hinge links, that is, by making it in the form of a tongue cut from one of the hinge links so as to be free at one end but still integral with the hinge link, the tongue being permanently bent out of the plane of the hinge link towards the other hinge link, but being able to yield resiliently.

If the hinge of the invention is an over-center hinge whose supporting wall member is in the form of an elongated arm, and an over-center mechanism is provided which consists of a pusher under spring bias which engages a projection of the arm end of the outer hinge link, and which, in the case of a swing from the closed position to the open position, first biases the outer hinge link in the closing position until a dead center position is reached, and then biases it in the opening direction after the dead center position is passed, it is desirable to construct the damping means in the form of a resiliently flexible arm projecting from the pusher into the space between the hinge links, which, as the open position is approached, engages the side of the inner hinge link facing the outer hinge link and yields resiliently. The damping means is thus integrated into the over-center mechanism.

In further advantageous development of the invention, the construction can then be such that, at the free end of the resiliently flexible arm, an abutment portion is provided which is bent towards the pintle at the supporting arm end of the outer hinge link, its length being so proportioned that, in the design open position, it engages the pintle whereby the outer hinge link is articulated to the supporting arm, or it engages the eye fitted to this pintle. This abutment portion determines the position of the door member of the hinge and consequently of the door in the open position, since after it engages the pintle or the eye fitted thereon, it prevents any further swinging of the door member of the hinge toward the open position. Since, on the other hand, the bias of the spring(s) of the over-center mechanism seeks to swing the door member further in the open direction, and this spring bias exerts a higher torque than the braking torque produced by the deformation of the resiliently flexible arm, a detention of the door in an open position determined by the length of the abutment portion is brought about. The abutment portion can therefore be considered as a part of a detent mechanism holding the hinge, and the door mounted thereby, in the open position. By varying the length of the abutment portion it is possible to predetermine the maximum opening angle of a door which is to be fitted with the hinge of the invention. For example, a hinge which is to be opened to an angle of 115° can be limited to an open angle of 90° by establishing accordingly the length of this abutment portion.

The pusher, the flexible arm and, if desired, the abutment portion, are preferably injection molded from plastic.

Also, where the hinge is a quadruple knuckle joint hinge without an over-center mechanism and the damping means is provided separately on one of the hinge links, the damping means is preferably made of plastic or rubber for reasons of economy. Alternatively, the damping means can also be made of a metallic material, in the form, for example, of a metal leaf spring.

The invention will be further explained in the following description of two embodiments in conjunction with the drawing, wherein.

Figure 1:
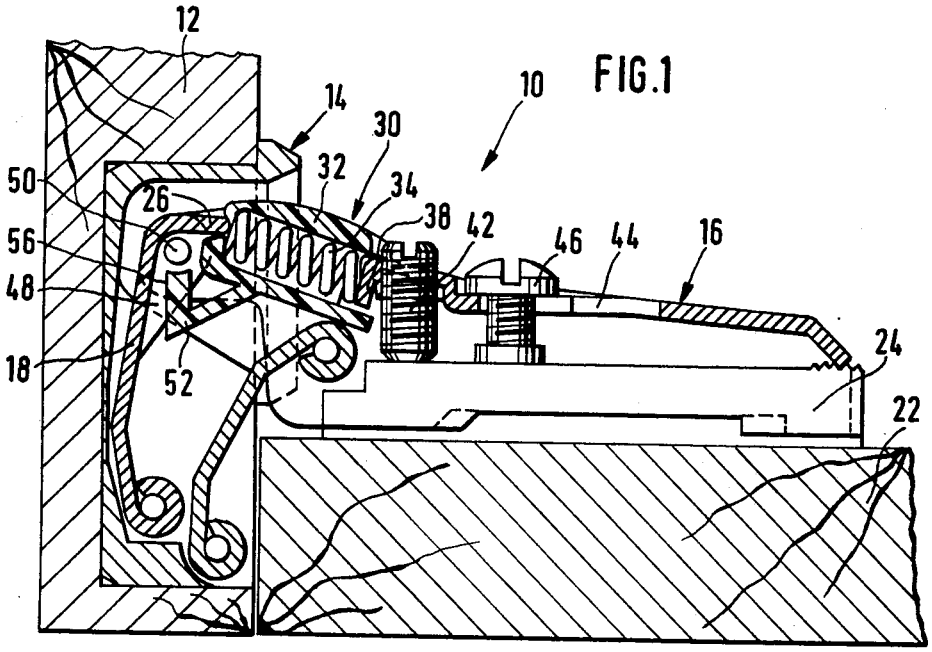
FIG. 1 is a cross sectional view taken along a plane passing through the longitudinal central axis of an embodiment of a quadruple knuckle joint hinge of the invention provided with an over-center mechanism, the hinge being in the closed position.
Figure 2:
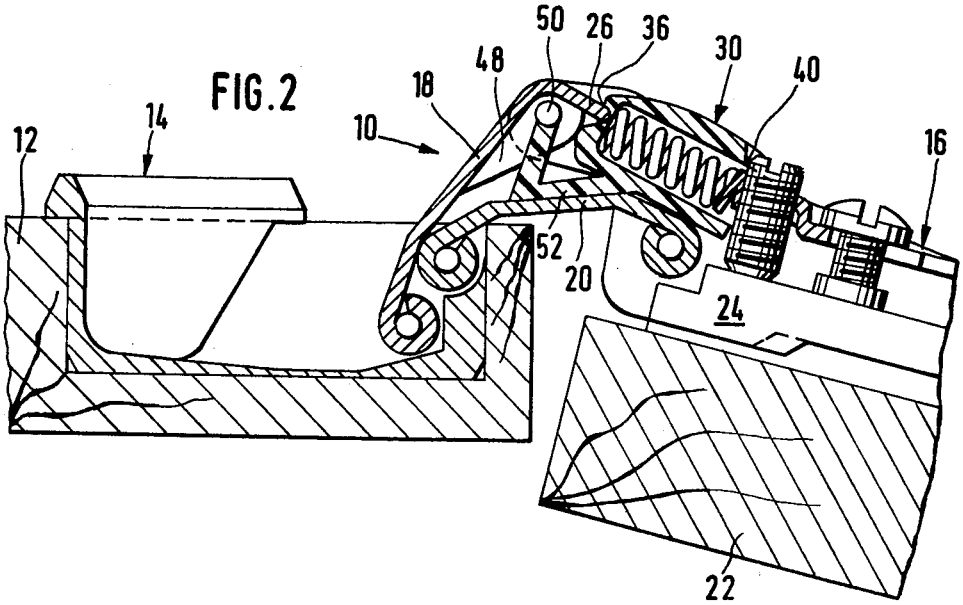
FIG. 2 is a cross sectional view corresponding to FIG. 1, taken through the hinge of FIG. 1 which is in the open position.

The hinge of the invention, which is shown in FIGS. 1 and 2 and identified as a whole by the number 10, is a quadruple knuckle joint hinge in which the door-related hinge member, constructed as a hammer-in or snap-in cup 14 inserted in a matching rabbet in the cabinet door 12, is pivotingly joined by two hinge links 18 and 20 to the wall-related member which is in the form of an elongated supporting arm 16. The mounting of the supporting arm 16 on the side-wall 22 of the cabinet is performed in a known manner by attaching it to a mounting plate fastened to the sidewall 22.

The over-center mechanism of the hinge 10 has a projection 26 on the supporting-arm end of the hinge link 18, and a resilient means 30 disposed in an opening in the upper side of the supporting arm 16, which in the case illustrated, consists of a hollow pusher 32 made of plastic and open at one end, and two coil springs 34 which are under compressive bias and are disposed parallelly adjacent one another in the pusher. The closed end of the pusher is provided on the outside with a groove-like transverse recess 36 in which the free end of the projection 26 is engaged, while the ends of coil springs 34 at the open end of the pusher apply thrust to a tab 38 which is formed on the supporting arm edge defining the inside of the opening in the upper side of the supporting arm 16 and which faces the interior of the supporting arm. The groove-like recess 36 is preferably made of such a depth that, at the bottom of the recess, it just breaks through to the interior of the pusher 32. The projection 26 of the hinge link 18 then bears directly against the innermost spiral of the springs 34, thereby preventing wear on the pusher in the recess 36. At its rearward end, the pusher 32 is slightly prolonged so that it projects slightly beyond the tab 38 at the top and bottom and is guided in this area by the tab. The opening 40 which can be seen in FIG. 2 in the upper, prolonged portion of the pusher 32 permits access to a threaded bore beneath it in the supporting arm, which accommodates a set screw 42 whereby the position of the supporting arm 16 relative to the mounting plate 24 can be varied. The fastening of the supporting arm 16 on the mounting plate 24 for longitudinal adjustment is accomplished in a conventional manner by means of the set screw 46 which passes through an elongated slot 44 in the supporting arm 16 and is threaded into the mounting plate 24, as shown in FIG. 1.

The projection 26 of the hinge link 18 is aligned relative to the pivot axis of the hinge link 18 on supporting arm 16 such that the spring forces exerted on it through the pusher 32 produce a torque which, in the closed position (FIG. 1), seeks to swing the hinge links in the closing direction and, in the open position (FIG. 2), seeks to swing them in the opening direction.

For the mounting on the supporting arm side, the hinge link 18 has in its terminal portion two sidewalls 48 bent at right angles, in which bearing bores are provided for the corresponding pintle 50 which is riveted in the supporting arm and forms the pivot for the hinge link 18.

On the bottom of pusher 32 facing the inner hinge link 20 an arm 52 projecting obliquely between the hinge links 20 and 18 is formed in one piece with the pusher by injection molding, and, as seen in FIG. 2, when the hinge 10 is swung to the open position, shortly before reaching the fully open position, it comes into engagement with the side of the inner hinge link 20 facing the outer hinge link 18, and then flexes resiliently in the rest of the movement, stopping the door 12 mounted on the hinge. The stopping action can be varied greatly through the selection of the plastic and by changing the thickness and length and the shape of the arm 52.

At the free end of the arm 52, an abutment portion 56 bent back towards the pintle 50 is created by injection molding, and, when the fully open position of the hinge is reached, comes into engagement with the pintle 50. The overflexing of the arm 52 is thus reliably prevented. By varying the length of the abutment portion 56, the maximum opening angle of a hinge can be adjusted to a given value. By lengthening the abutment portion 56, for example, the hinge 10, which has an opening angle of 115° in the case here represented, can be restricted to an opening angle of 90°, for example.

Figure 3:
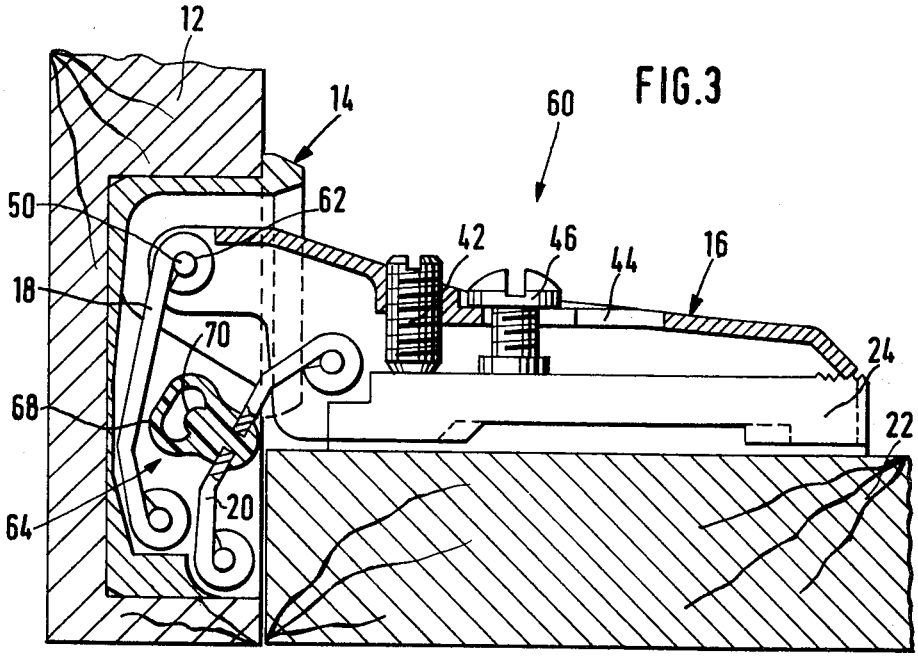
FIG. 3 is a cross sectional view corresponding to FIG. 1, taken through a second embodiment of a hinge of the invention, without an over-center mechanism.
Figure 4:
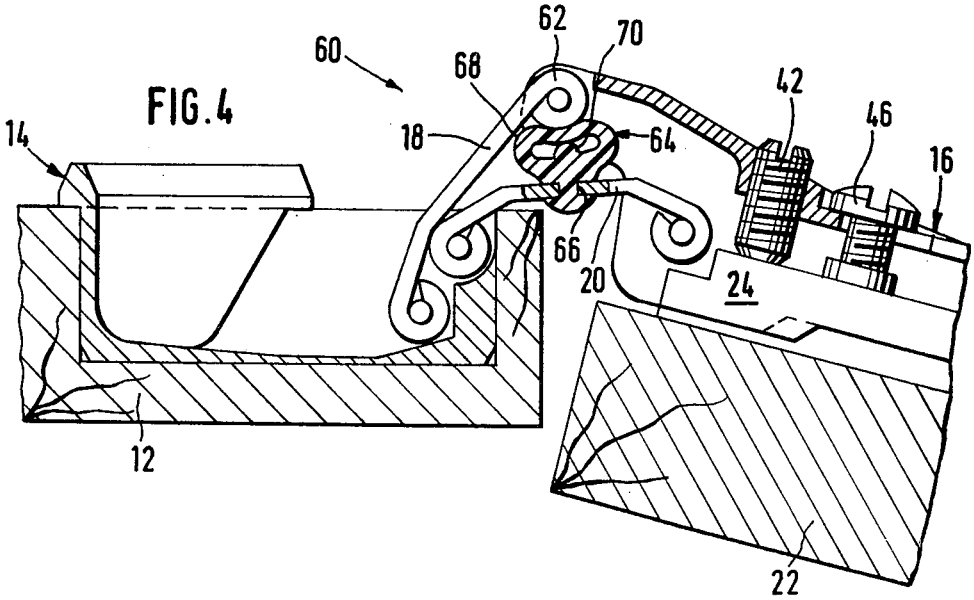
FIG. 4 is a cross sectional view corresponding to FIG. 3, taken through the hinge shown in FIG. 3 in the open position.

The hinge 60 shown in FIGS. 3 and 4 is largely the same as the one previously described in conjunction with FIGS. 1 and 2, and the corresponding parts are given the same reference numbers, so that the description of hinge 10 can be referred to as far as those parts are concerned. In contradistinction to hinge 10, however, hinge 60 lacks an over-center mechanism, so that components corresponding to the projection 26, the pusher 32 and the springs 34 are absent. The mounting of the end of the outer hinge link 18 on the support arm side is accomplished, in contradistinction to the mounting of the outer hinge link of hinge 10, by means of the conventional rolled bearing eye 62.

The damping means 64 in the case of hinge 60 is constructed as a separate, resiliently deformable plastic element which is fastened on the side of the inner hinge link 20 facing the outer hinge link 18, in a central area thereof in which, as the hinge approaches the open position, it comes into engagement with the rolled bearing eye 62 of the outer hinge link 18 and, by its resilient deformation, stops the door mounted by means of hinge 60.

The damping element 64 is fastened, in the case represented in the drawing, in a bore 66 in the inner hinge link 20, This damping element, which is appropriately shaped on its side facing the hinge link 20, is snapped into the bore, for example, or it can be cemented therein.

In order to achieve the required resilient deformability, the damping element 64 is given the arcuate form seen in FIG. 3 in its deformable portion 68. As the open position is approached, the arcuate portion 68 is pressed flat resiliently in the manner shown in FIG. 4. A projection 70 provided in the interior of the arcuate section 68 corresponds in its function to the abutment portion 56 of hinge 10. By varying the length of this projection 70, an adjustment of the maximum opening angle 60 can again be accomplished, within certain limits.

It is apparent that a number of modifications and further developments can be realized within the scope of the invention. Thus, the damping element can have a shape different from the shapes described, and can be made of another material, as long as it is resiliently deformable. The damping element can be made from the material of one of the hinge links itself by cutting a tongue that is integral with the link and bending it permanently in the direction of the other link, the degree of this bend in the direction of the other link determining the onset of its damping or braking operation when the door mounted on the hinge is opened, and determining the magnitude of its resilience, i.e., the strength of its stopping action. Instead of being provided on the inner link 20, it could likewise be provided on the side of the outer link 18 facing the inner link 20.

We claim:

1. A cabinet hinge movable from an open to a closed position and vice versa and having an inner and an outer hinge link each pivotingly attached to a door-related member on the one hand and to a wall-related member on the other, in the manner of a quadruple knuckle joint, said hinge links being spaced from each other, said supporting wall-related member being constructed as an elongated supporting arm, an over-center mechanism formed by a pusher, a spring biasing said pusher, a projection on the supporting arm end of said outer hinge link and engaged by said pusher, said pusher, upon a swing from the closed to the open position, urging the outer hinge link first in the closing direction up to a dead center position and, on the other side of the dead center position, urging it in the opening direction, resiliently deformable damping means disposed in the space between said hinge links, said damping means being a resiliently flexible arm projecting from the pusher into the area between the hinge links, which damping means, when the open position is approached, engages the side of the inner hinge link facing the outer hinge link and flexes resiliently upon further opening movement.

2. A hinge according to claim 1, comprising a pivot connecting said outer link to said supporting arm, and wherein an abutment section is provided at the free end of the resiliently bendable arm, said abutment section being bent back to the supporting-arm-side pivot of the outer hinge link, the length of said abutment section being such that, in the predetermined open position, it engages said pivot connecting the outer hinge link pivotingly to the supporting arm.

3. A hinge according to claim 2, wherein said pusher and bendable arm are injection molded integrally from plastic.

4. A hinge according to claim 2, wherein said pusher, bendable arm and abutment section are injection molded integrally from plastic.

5. A hinge according to claim 1, comprising a pivot connecting said outer link to said supporting arm and having a bearing eye fitted to said pivot, and wherein an abutment section is provided at the free end of the resiliently flexible arm, said abutment section being bent back to the supporting-arm-side pivot of the outer hinge link, the length of said abutment section being such that, in the predetermined open position, it engages said bearing eye.

6. A hinge according to claim 5, wherein said pusher and bendable arm are injection molded integrally from plastic.

7. A hinge according to claim 5, wherein said pusher, bendable arm and abutment section are injection molded intetrally from plastic.

* * * * *